US009541881B2

(12) United States Patent
Hozumi et al.

(10) Patent No.: US 9,541,881 B2
(45) Date of Patent: Jan. 10, 2017

(54) RECORDING MEDIUM CONVEYING DEVICE WITH A SEPARATION SUPPORT ROLLER AND IMAGE FORMING APPARATUS INCORPORATING THE SAME

(71) Applicants: Yoshiki Hozumi, Kanagawa (JP); Naomi Sugimoto, Kanagawa (JP); Kazuchika Saeki, Kanagawa (JP)

(72) Inventors: Yoshiki Hozumi, Kanagawa (JP); Naomi Sugimoto, Kanagawa (JP); Kazuchika Saeki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/924,839

(22) Filed: Oct. 28, 2015

(65) Prior Publication Data

US 2016/0139553 A1 May 19, 2016

(30) Foreign Application Priority Data

Nov. 13, 2014 (JP) ..... 2014-230405

(51) Int. Cl.

| | |
|---|---|
| ***G03G 15/16*** | (2006.01) |
| ***G03G 15/00*** | (2006.01) |
| ***B65H 5/02*** | (2006.01) |
| ***B65H 5/36*** | (2006.01) |

(52) U.S. Cl.

CPC ..... *G03G 15/6529* (2013.01); *B65H 5/021* (2013.01); *B65H 5/36* (2013.01)

(58) Field of Classification Search

CPC ..... G03G 15/6529
USPC ..... 399/312
See application file for complete search history.

(56) References Cited

U.S. PATENT DOCUMENTS 7,810,633 B2 * 10/2010 Okamoto ..... G03G 15/755 198/806
2013/0306440 A1 11/2013 Asaoka et al.
2013/0306441 A1 11/2013 Asaoka et al.
2014/0083821 A1 3/2014 Hozumi et al.
2014/0183007 A1 7/2014 Hozumi et al.
(Continued)

FOREIGN PATENT DOCUMENTS

JP 2005134415 A * 5/2005
JP 2006-163097 6/2006
(Continued)

OTHER PUBLICATIONS

U.S. Appl. No. 14/690,857, filed Apr. 20, 2015, Yoshiki Hozumi, et al.
(Continued)

*Primary Examiner* — Quana M Grainger
(74) *Attorney, Agent, or Firm* — Oblon, McClelland, Maier & Neustadt, L.L.P.

(57) ABSTRACT

A recording medium conveying device includes an endless belt to convey a recording medium, a plurality of support rollers around which the belt is wound, to rotate the belt, and a cleaner in contact with the belt to clean the belt. One of the plurality of support rollers is a separation support roller, mounted on a tiltable rotary shaft, to separate the recording medium from the belt using a curvature of the separation support roller. The separation support roller includes a contact member to contact an edge of the belt when the belt laterally moves toward one side of the belt.

7 Claims, 9 Drawing Sheets

(56) References Cited

U.S. PATENT DOCUMENTS

| | | | |
|---|---|---|---|
| 2014/0209437 | A1 | 7/2014 | Hozumi et al. |
| 2015/0090564 | A1 | 4/2015 | Iwaya et al. |
| 2015/0117914 | A1 | 4/2015 | Hozumi et al. |
| 2015/0125189 | A1 | 5/2015 | Hozumi et al. |
| 2015/0227089 | A1 | 8/2015 | Hozumi et al. |

FOREIGN PATENT DOCUMENTS

| | | |
|---|---|---|
| JP | 2006-267243 | 10/2006 |
| JP | 2010-230958 | 10/2010 |
| JP | 2012-103286 | 5/2012 |
| JP | 2012-237911 | 12/2012 |

OTHER PUBLICATIONS

U.S. Appl. No. 14/796,353, filed Jul. 10, 2015, Yoshiki Hozumi, et al.

* cited by examiner

IMMEDIATELY AFTER ASSEMBLY

AFTER ADJUSTMENT

RECORDING MEDIUM CONVEYING DEVICE WITH A SEPARATION SUPPORT ROLLER AND IMAGE FORMING APPARATUS INCORPORATING THE SAME

CROSS-REFERENCE TO RELATED APPLICATION

This patent application is based on and claims priority pursuant to 35 U.S.C. §119(a) to Japanese Patent Application No. 2014-230405, filed on Nov. 13, 2014, in the Japan Patent Office, the entire disclosure of which is hereby incorporated by reference herein.

BACKGROUND

Technical Field

Exemplary aspects of the present invention generally relates to a recording medium conveying device and an image forming apparatus incorporating the recording medium conveying device.

Related Art

Image forming apparatuses may include latent image bearers to bear toner images thereon and an intermediate transferor on which the toner images are primarily transferred and from which the toner images are secondarily transferred onto a recording medium. For example, an image forming apparatus includes a recording medium conveying device (e.g., a secondary transfer device) to secondarily transfer toner images from an intermediate transferor onto a recording medium while conveying the recording medium interposed between the intermediate transferor and a belt (e.g., a secondary transfer belt) entrained about and stretched taut around a plurality of support rollers.

SUMMARY

In an aspect of this disclosure, there is provided an improved recording medium conveying device that includes an endless belt to convey a recording medium, a plurality of support rollers around which the belt is wound, to rotate the belt, and a cleaner in contact with the belt to clean the belt. One of the plurality of support rollers is a separation support roller, mounted on a tiltable rotary shaft, to separate the recording medium from the belt using a curvature of the separation support roller. The separation support roller includes a contact member to contact an edge of the belt when the belt laterally moves toward one side of the belt.

In another aspect of this disclosure, there is provided an improved image forming apparatus including a latent image bearer, a latent image forming device to form a latent image on the latent image bearer, a developing device to transfer toner onto the latent image formed on the latent image bearer to form a toner image on the latent image bearer, the above-described recording medium conveying device to convey a recording medium, and a transfer device to transfer the toner image, which has been formed on the latent image bearer, onto the recording medium to form an image on the recording medium.

BRIEF DESCRIPTION OF THE DRAWINGS

The aforementioned and other aspects, features, and advantages of the present disclosure will be better understood by reference to the following detailed description when considered in connection with the accompanying drawings, wherein.

Figure 1:
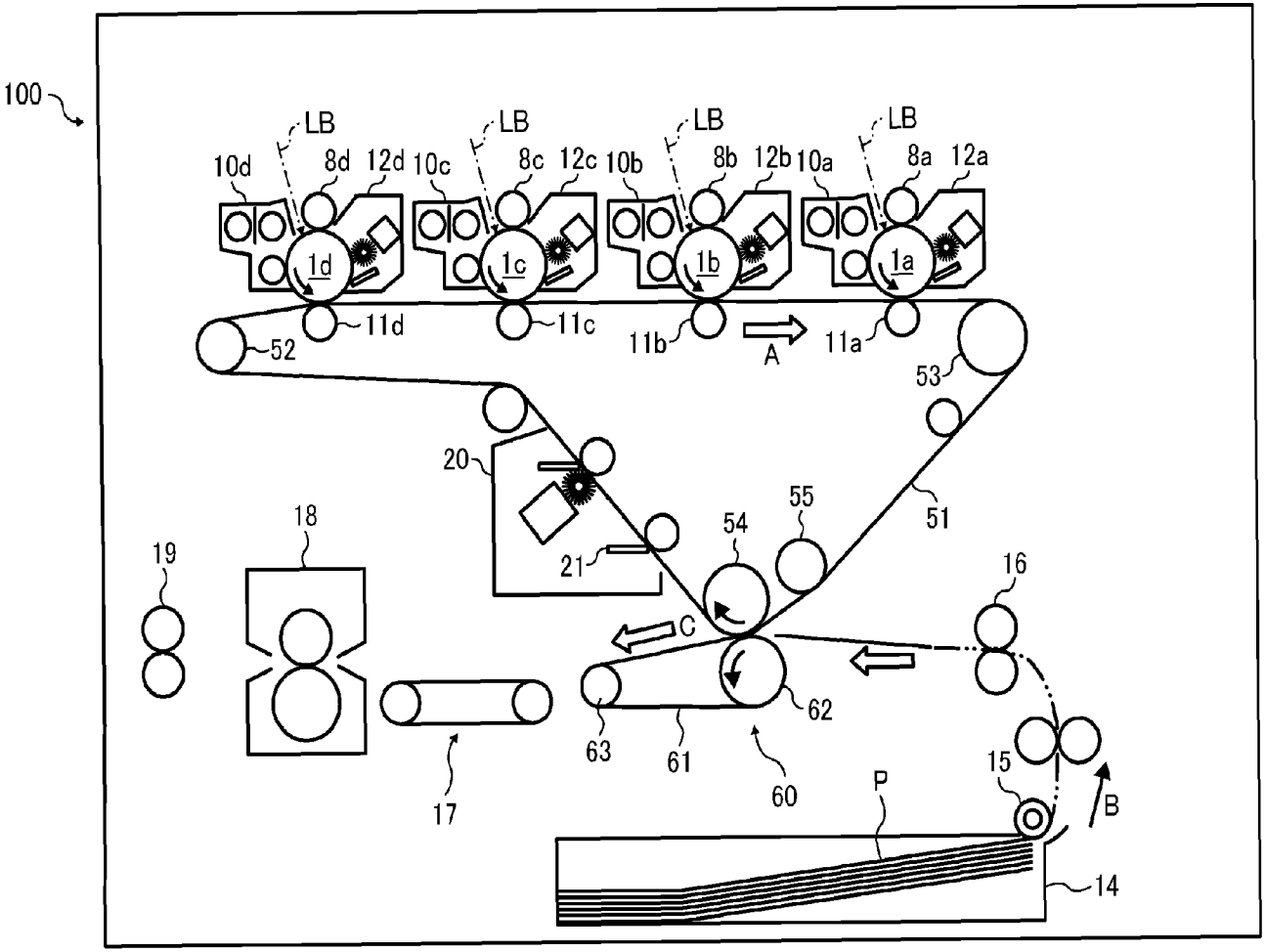
FIG. 1 is a schematic diagram illustrating the relevant sections of a printer as an example of an image forming apparatus, according to an illustrative embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

FIG. 1 is a schematic diagram illustrating the relevant sections of a printer 100 as an example of an image forming apparatus of the present disclosure.

The image forming apparatus includes four photoconductors 1*a*, 1*b*, 1*c*, and 1*d* disposed inside a main body housing of the image forming apparatus. Toner images of different colors are formed on the respective photoconductors 1*a*, 1*b*, 1*c*, and 1*d*. More specifically, a black toner image, a magenta toner image, a cyan toner image, and a yellow toner image are formed on the photoconductors 1*a*, 1*b*, 1*c*, and 1*d*, respectively. According to the present illustrative embodiment, the photoconductors 1*a*, 1*b*, 1*c*, and 1*d* are drums. Alternatively, the photoconductors 1*a*, 1*b*, 1*c*, and 1*d* may employ an endless looped belt entrained about a plurality of rollers and driven to rotate.

The image forming apparatus includes an intermediate transfer belt 51 formed into an endless loop as an intermediate transferor that serves as an image bearer. The intermediate transfer belt 51 faces the four photoconductors 1*a*, 1*b*, 1*c*, and 1*d*. The outer circumferential surface of each of the photoconductors 1*a*, 1*b*, 1*c*, and 1*d* contacts the outer circumferential surface of the intermediate transfer belt 51. The intermediate transfer belt 51 is entrained about and stretched taut between a plurality of support rollers: a tension roller 52, a drive roller 53, a repulsive roller 54, an entry roller 55, and so forth. The drive roller 53, which is one of the support rollers, is driven to rotate by a drive source, and rotation of the drive roller 53 allows the intermediate transfer belt 51 to travel in a direction of arrow A in FIG. 1.

The intermediate transfer belt 51 may be a single-layer belt or a multi-layer belt. In the case of the multi-layer belt, a base layer of the belt may be desirably formed of a relatively inelastic fluorine resin such as a polyvinylidene fluoride (PVDF) sheet and polyimide resin, with a smooth coating layer of fluorine resin deposited on the outer surface of the belt. In the case of a single-layer belt, the belt material may be selected from, for example, polyvinylidene difluoride (PVDF), polycarbonate (PC), and polyimide (PI).

The configuration and operation for forming toner images on each of the photoconductors 1*a*, 1*b*, 1*c*, and 1*d* is the same, differing only in the color of toner employed. Similarly, the configuration and operation for transferring primarily the toner images onto the intermediate transfer belt 51 is the same, differing only in the color of toner employed. Thus, a description is provided only of the configuration and operation for forming a black toner image on the photoconductor 1*a* and primarily transferring the tone image onto the intermediate transfer belt 51, and a description for the other colors is omitted.

The photoconductor 1*a* rotates in the counterclockwise direction as indicated by arrows in FIG. 1. The outer circumferential surface of the photoconductor 1*a* is irradiated with light, thereby initializing the surface potential of the photoconductor 1*a*. The initialized outer circumferential surface of the photoconductor 1*a* is given a uniform charge by a charging device 8*a* of a predetermined polarity (in the present illustrative embodiment, a negative polarity). Subsequently, an exposure device irradiates the charged outer circumferential surface of the photoconductor 1*a* with a modulated laser beam LB, thereby forming an electrostatic latent image on the surface of the photoconductor 1*a*.

According to the present illustrative embodiment, the exposure device that projects the laser beam LB is a laser writing device. Alternatively, the exposure device may be a light emitting diode (LED) array and an imaging device. The electrostatic latent image formed on the photoconductor 1*a* is developed with black toner by a development device 10*a* into a visible image as a black toner image when passing between the photoconductor 1*a* and the development device 10*a*. It is to be noted that reference numerals 10*b*, 10*c*, and 10*d* also refer to development devices.

A primary transfer roller 11*a* is disposed inside the looped intermediate transfer belt 51, facing the photoconductors 1*a*. Reference numerals 11*b*, 11*c*, and 11*d* also refer to primary transfer rollers. The primary transfer roller 11*a* contacts the inner circumferential surface of the intermediate transfer belt 51 to form a primary transfer nip between the photoconductor 1*a* and the intermediate transfer belt 51. The primary transfer roller 11*a* is supplied with a primary transfer voltage having a polarity (in the present illustrative embodiment, a positive polarity) opposite a charge polarity of the toner image formed on the photoconductor 1*a*, thereby forming a primary transfer electric field between the photoconductor 1*a* and the intermediate transfer belt 51 and electrostatically transferring the toner image onto the intermediate transfer belt 51, which rotates with the photoconductor 1*a*. After the toner image is primarily transferred onto the intermediate transfer belt 51, residual toner remaining on the surface of the photoconductor 1*a* is removed by a cleaning device 12*a*. Similarly, the photoconductors 1*b*, 1*c*, and 1*d* are cleaned by cleaning devices 12*b*, 12*c*, and 12*d*, respectively.

In a full color mode in which toner images of four different colors are formed, similar to the black toner image, a magenta toner image, a cyan toner image, and an yellow toner image are formed on the photoconductors 1*b*, 1*c*, and 1*d*, respectively. The toner images in the colors magenta, cyan, and yellow are transferred onto the intermediate transfer belt 51 sequentially, and the black toner image is then superimposed on them ultimately.

It should be noted that when forming a single color image of black color in a monochrome mode, the primary transfer rollers 11*b*, 11*c*, and 11*d* are separated from the photoconductors 1*b*, 1*c*, and 1*d* for the colors magenta, cyan, and yellow by a contact-and-separation device, such that, in a state in which only the photoconductor 1*a* is in contact with the intermediate transfer belt 51, only the black toner image is transferred primarily onto the intermediate transfer belt 51.

As illustrated in FIG. 1, a paper feed device 14 is disposed substantially at the bottom of the main body of the image forming apparatus. The paper feed device 14 includes a feed roller 15 to pick up and send a recording medium P as transfer paper in a direction indicated by arrow B in FIG. 1. The recording medium P fed by the feed roller 15 is delivered in a predetermined timing to a secondary transfer nip at which the intermediate transfer belt 51 looped around the repulsive roller 54 contacts a secondary transfer belt 61 of a secondary transfer device 60. The recording medium P is sent to the secondary transfer nip in appropriate timing by a pair of registration rollers 16. At this time, a secondary-transfer power source as a transfer voltage output device supplies a predetermined secondary transfer voltage to the repulsive roller 54 to effect secondary transfer of the toner image from the intermediate transfer belt 51 onto the recording medium P.

In the secondary transfer device 60, the secondary transfer belt 61 is entrained about and stretched taut between a secondary transfer roller 62 and a separation roller 63. Rotation of one of the secondary transfer roller 62 and the separation roller 63 (support rollers) enables the secondary transfer belt 61 to travel in a direction indicated by arrow C in FIG. 1. The recording medium P, onto which the toner image is secondarily transferred, is carried on the outer circumferential surface of the secondary transfer belt 61 and transported while the recording medium P is attracted electrostatically to the outer circumferential surface of the secondary transfer belt 61. Subsequently, the recording medium P separates from the surface of the secondary transfer belt 61 at the curved portion of the secondary transfer belt 61 entrained about the separation roller 63, and is transported further downstream from the secondary transfer belt 61 in a transport direction of the recording medium P by a conveyor belt 17 disposed downstream from the secondary transfer belt 61. When the recording medium P passes through a fixing device 18, which applies heat and pressure to the toner image on the recording medium P, the toner image is fixed to the recording medium P. After the recording medium P passes through the fixing device 18, the recording medium P is discharged outside the main body through a pair of output rollers 19 of a discharge unit.

Residual toner remaining on the intermediate transfer belt 51 after the toner image is secondarily transferred therefrom is then removed by a belt cleaning device 20. In the present illustrative embodiment, the belt cleaning device 20 includes a cleaning blade 21 made of urethane, contacting the intermediate transfer belt 51 in a direction opposite to the traveling direction of the intermediate transfer belt 51. Alternatively, instead of a cleaning blade, any suitable cleaner may be used to clean the intermediate transfer belt 51, including, for example, an electrostatic cleaner for electrostatically removing toner residues from the belt surface.

Next, a description is provided of the configuration and operation of a belt alignment device employed in the secondary transfer device 60 equipped with the secondary transfer belt 61.

According to the present illustrative embodiment, the belt alignment device employed in the secondary transfer device 60 includes a shaft moving device 70 to tilt a rotary shaft 63*a* of the separation roller 63 about which the secondary transfer belt 61 is entrained so as to adjust misalignment of the secondary transfer belt 61 within a predetermined permissible range. The separation roller 63 is one of support rollers around which the secondary transfer belt 61 is entrained.

Figure 2:
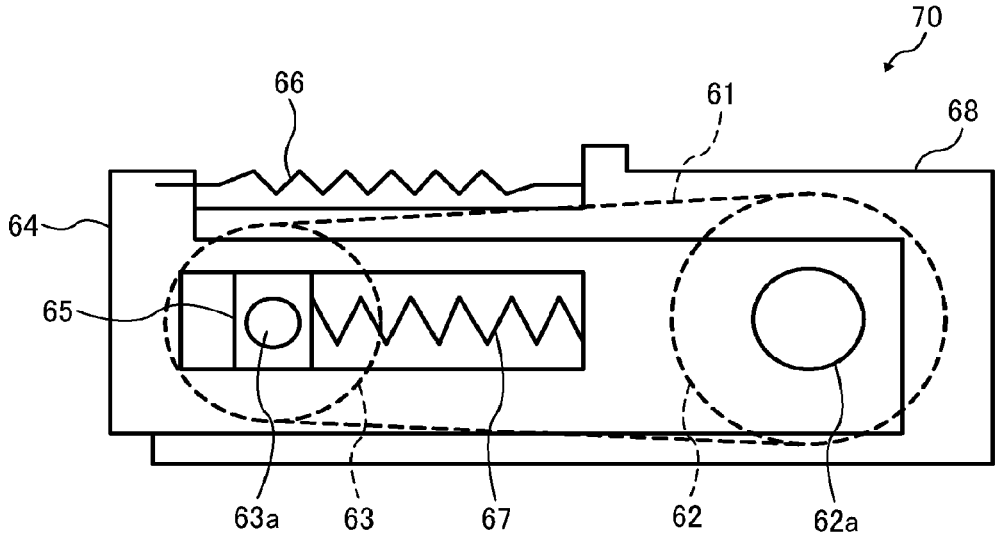
FIG. 2 is a schematic diagram illustrating a shaft moving device of a secondary transfer device employed in the image forming apparatus of FIG. 1 immediately after assembly viewed axially along a separation roller.

FIG. 2 is a schematic diagram of the configuration of the shaft moving device 70 of the secondary transfer device 60 immediately after assembly, viewed axially along the separation roller 63.

Figure 3:
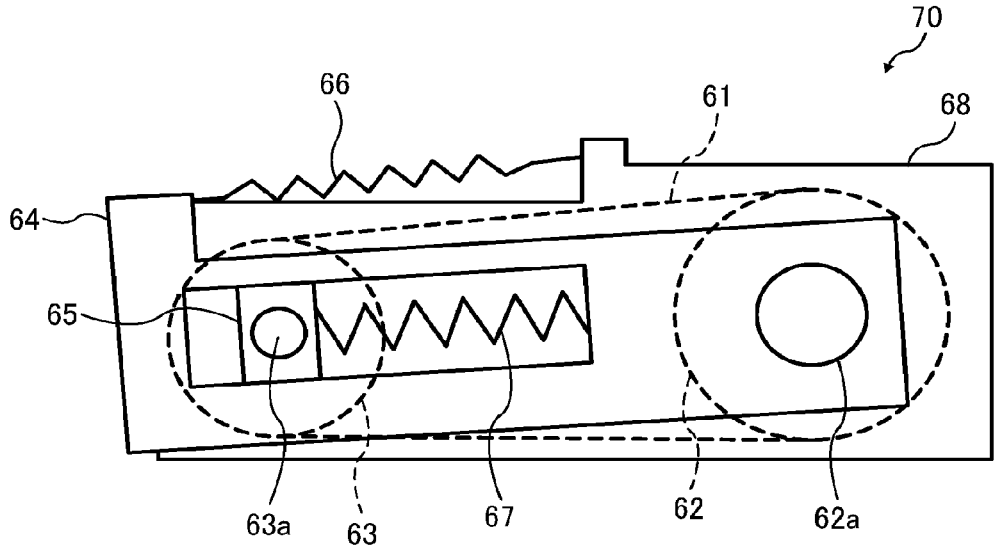
FIG. 3 is a schematic diagram illustrating the shaft moving device after adjustment of misalignment of a belt viewed axially along the separation roller.

FIG. 3 is a schematic diagram of the configuration of the shaft moving device 70 after adjustment of misalignment of the secondary transfer belt 61, viewed axially along the separation roller 63.

Each end of the rotary shaft 63*a* of the separation roller 63 is supported individually by different shaft support arms 64. Each shaft support arm 64 is rotatably attached to both ends of the rotary shaft 62*a* of the secondary transfer roller 62 and is biased in a clockwise direction in FIG. 2 by an arm spring 66 with one end thereof fixed to a frame 68 of the secondary transfer device 60. In a state in which there is no misalignment of the secondary transfer belt 61 immediately after assembly, a rotation position of the shaft support arms 64 is maintained at a position at which the shaft support arms 64 contact the frames 68 due to a bias force of the arm spring 66 as illustrated in FIG. 2.

As illustrated in FIGS. 2 and 3, each shaft support arm 64 slidably supports a shaft bearing 65 that bears the rotary shaft 63*a* of the separation roller 63, such that the shaft bearing 65 is slidable in a radial direction from the center of rotation of the shaft support arm 64. The shaft bearing 65 is biased outward by a tension spring 67 in the radial direction from the center of rotation of the shaft support arms 64. With this configuration, the separation roller 63 is always biased in such a direction that the separation roller 63 separates from the secondary transfer roller 62. Accordingly, a certain tension is applied to the secondary transfer belt 61 looped around the separation roller 63 and the secondary transfer roller 62.

Figure 4:
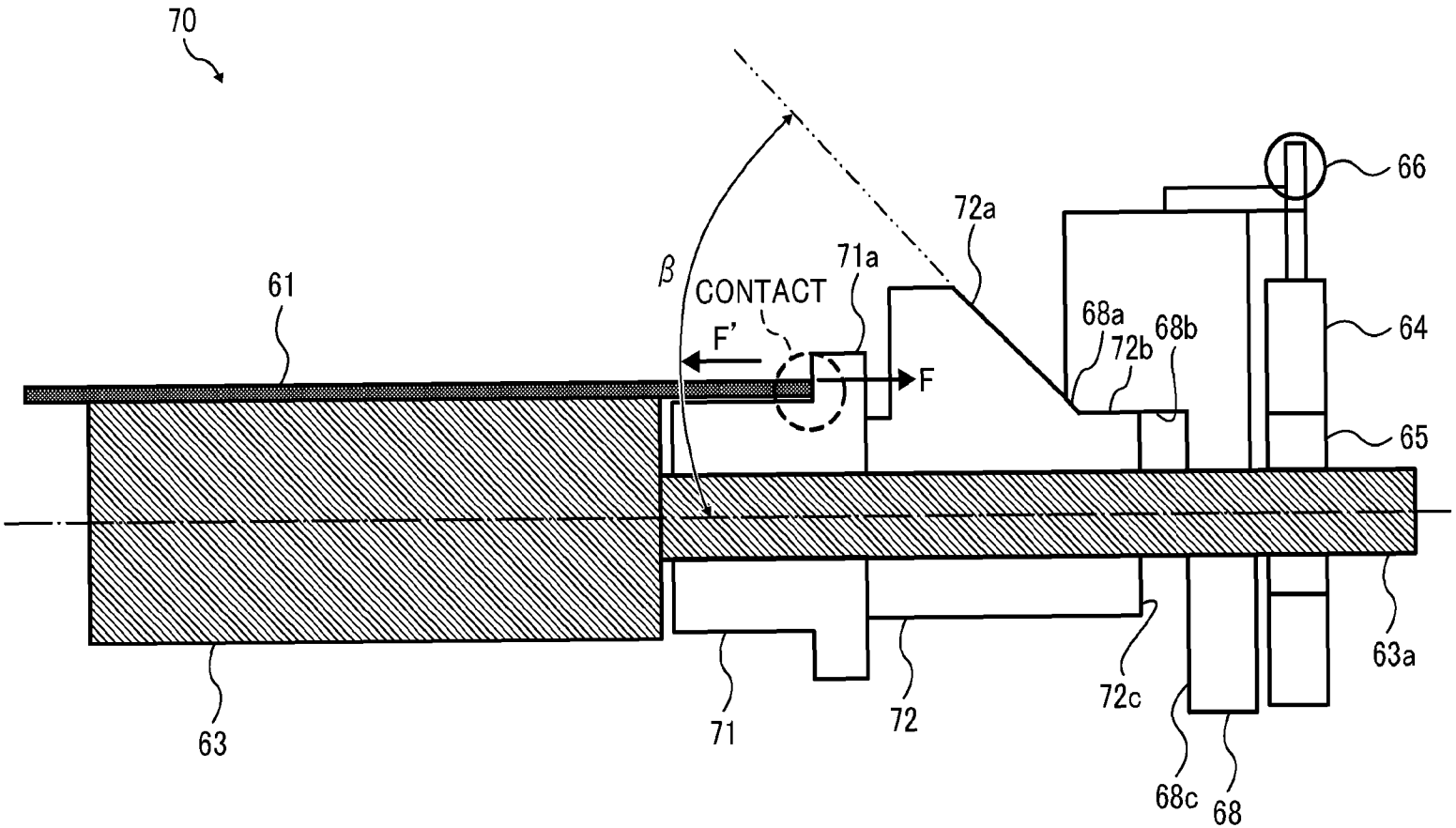
FIG. 4 is a cross-sectional diagram schematically illustrating the shaft moving device immediately after assembly, taken along a rotary shaft of the separation roller.

FIG. 4 is a cross-sectional diagram of the shaft moving device 70 of the secondary transfer device 60, cut along the rotary shaft 63*a* of the separation roller 63.

A belt deviation detector 71 and a shaft inclining member 72 are disposed on the rotary shaft 63*a* between the separation roller 63 and the shaft bearing 65. The belt deviation detector 71 and the shaft inclining member 72 together constitute an axial-direction displacement device. The belt deviation detector 71 includes a flange 71*a* that contacts an edge of the secondary transfer belt 61. As the secondary transfer belt 61 moves laterally in the direction of the belt width and the edge of the secondary transfer belt 61 contacts the flange 71*a*, exerting a force on the belt deviation detector 71 in the direction of arrow F, the belt deviation detector 71 moves outward in the axial direction along the rotary shaft 63*a* of the separation roller 63. As the belt deviation detector 71 moves outward in the axial direction along the rotary shaft 63*a*, the shaft inclining member 72, which is disposed outside the belt deviation detector 71 on the rotary shaft 63*a*, moves outward in the axial direction along the rotary shaft 63*a*.

As illustrated in FIG. 4, the secondary transfer belt 61 receives a reaction force in a direction of arrow F' from the flange 71*a*. As a result, the secondary transfer belt 61 creases.

A contact portion 68*a* of the frame 68 serving as a fixation member contacts a slanted surface 72*a* of the shaft inclining member 72 in the axial direction of the rotary shaft 63*a*. The end portion of the rotary shaft 63*a* of the separation roller 63 on which the shaft inclining member 72 is disposed is supported, via the shaft bearing 65, by the shaft support arm 64, which is biased by the arm spring 66. Thus, the end portion of the rotary shaft 63*a* of the separation roller 63 is biased upward in FIG. 4. Accordingly, in a state in which the edge of the secondary transfer belt 61 is not in contact with the flange 71*a* of the belt deviation detector 71, the biasing force of the arm spring 66 adjusts the contact position at which the contact portion 68*a* of the frame 68 and the slanted surface 72*a* of the shaft inclining member 72 contact to a position at which a stopper surface 68*b* of the frame 68 contacts a contact surface 72*b* of the shaft inclining member 72. The contact surface 72*b* of the shaft inclining member 72 is continuously formed at the lower end of the slanted surface 72*a*. That is, the contact portion 68*a* of the frame 68 is held in a state in which the contact portion 68*a* contacts the lower end portion of the slanted surface 72*a* of the shaft inclining member 72.

In such a state, receiving a force of movement of the secondary transfer belt 61 in the direction of the belt width, the belt deviation detector 71 and the shaft inclining member 72 move outward along the rotary shaft 63*a*. As a result, the contact portion 68*a* of the flame 68 moves along the slanted surface 72*a* of the shaft inclining member 72 relative to the movement of the belt deviation detector 71 and the shaft inclining member 72. The contact position at which the slanted surface 72*a* of the shaft inclining member 72 contacts the contact portion 68*a* of the frame 68 moves up towards the upper portion of the slanted surface 72*a*.

Figure 5:
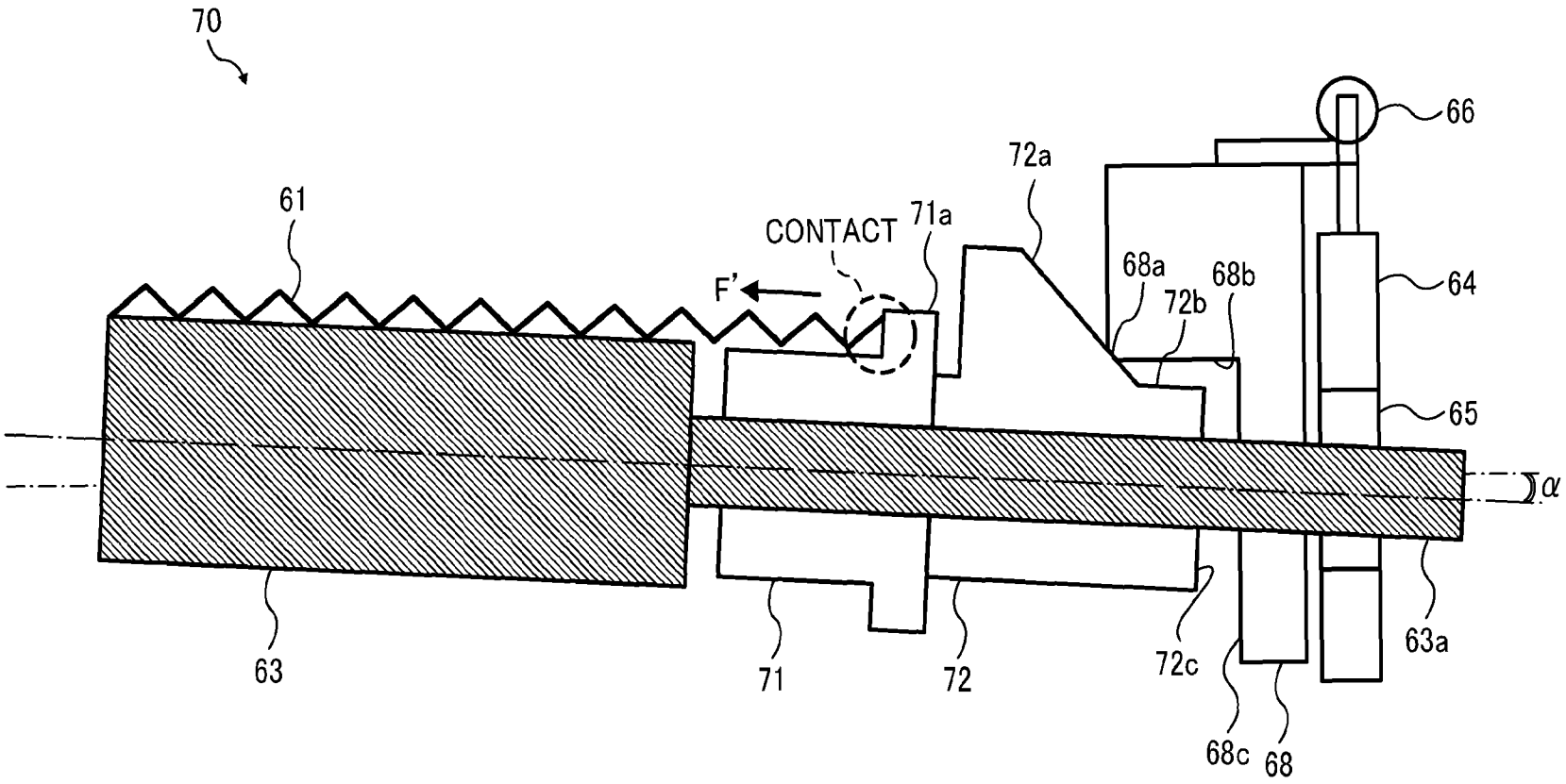
FIG. 5 is a cross-sectional diagram schematically illustrating the shaft moving device after adjustment of the misalignment of the belt, taken along the rotary shaft of the separation roller.

FIG. 5 is a cross-sectional diagram of the shaft moving device in a state in which the contact position at which the slanted surface 72*a* of the shaft inclining member 72 contacts the contact portion 68*a* of the frame 68 moves up towards the upper portion of the slanted surface 72*a* (after adjustment of the misalignment of the belt), taken along the rotary shaft of the separation roller.

The axial end portion of the rotary shaft 63*a* of the separation roller 63 in the moving direction of the secondary transfer belt 61 is pressed down against the biasing force of the arm spring 66 as illustrated in FIG. 5. At this time, at the opposite end portion of the rotary shaft 63*a* of the separation roller 63, which is the opposite end in the moving direction of the secondary transfer belt 61, the edge of the secondary transfer belt 61 is not in contact with the flange 71*a* of the belt deviation detector 71. Accordingly, as illustrated in FIG. 4, the contact portion 68*a* of the frame 68 is held in a state in which the contact portion 68*a* of the frame 68 contacts the lower end portion of the slanted surface 72*a* of the shaft inclining member 72, causing the rotary shaft 63*a* to tilt.

As the rotary shaft 63*a* of the separation roller 63 tilts further, the speed of movement of the secondary transfer belt 61 laterally in the direction of the belt width slows down gradually, and ultimately the secondary transfer belt 61 moves in the opposite direction. As a result, the position of the secondary transfer belt 61 in the width direction returns gradually, thereby enabling the secondary transfer belt 61 to travel reliably at a position at which misalignment of the secondary transfer belt 61 is corrected. The same is true for the case in which the direction of misalignment of the secondary transfer belt 61 is in the direction opposite to the direction described above.

Figure 6:
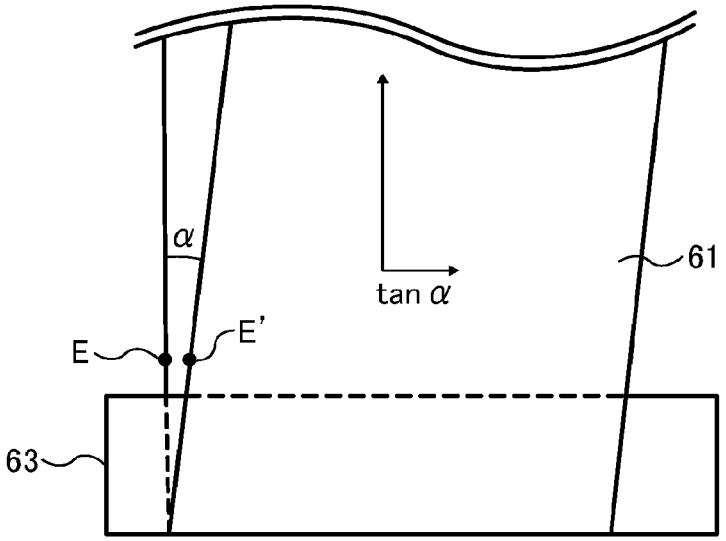
FIG. 6 is a conceptual diagram illustrating an example of misalignment of a secondary transfer belt of the secondary transfer device.

With reference to FIG. 6, a description is provided of a principle of correction of belt misalignment by tilting the rotary shaft 63*a* of the separation roller 63.

FIG. 6 is a conceptual diagram of misalignment of the secondary transfer belt 61.

Here, it is assumed that the secondary transfer belt 61 has a rigid body, and an arbitrary point (i.e., a point E on the belt edge) on the secondary transfer belt 61 before advancing to the separation roller 63 is observed. As long as the secondary transfer belt 61 entrained about and stretched taut between two rollers, i.e., the secondary transfer roller 62 and the separation roller 63, is completely horizontal or parallel, the position of the secondary transfer belt 61 in the axial direction of the separation roller 63 does not change between the point E on the secondary transfer belt 61 immediately before advancing to the separation roller 63 and a point E' corresponding to the point E immediately after exiting the separation roller 63. In this case, the secondary transfer belt 61 does not travel out of alignment.

In contrast, in a case in which the rotary shaft 63*a* of the separation roller 63 is inclined at an inclination angle $\alpha$ relative to the rotary shaft 62*a* of the secondary transfer roller 62, the point E on the secondary transfer belt 61 shifts by an amount of tan a in the axial direction of the separation roller 63 while moving along the peripheral surface of the separation roller 63 as illustrated in FIG. 6. Therefore, by tilting the rotary shaft 63*a* of the separation roller 63 at the inclination angle $\alpha$ relative to the rotary shaft 62*a* of the secondary transfer roller 62, the position of the secondary transfer belt 61 in the width direction of the belt can be moved approximately by the amount of tan a in accordance with the rotation of the separation roller 63.

The amount of belt misalignment (speed of movement in the width direction of the belt) of the secondary transfer belt 61 is proportional to the inclination angle $\alpha$. That is, the greater the inclination angle $\alpha$, the greater the amount of misalignment of the secondary transfer belt 61. The smaller the inclination angle $\alpha$, the smaller the amount of misalignment of the secondary transfer belt 61. For example, in a case in which the secondary transfer belt 61 wanders to the right side as illustrated in FIG. 5, this belt misalignment, i.e., an initial belt misalignment, causes the shaft inclining member 72 to move outward in the axial direction of the separation roller 63, thereby moving the rotary shaft 63*a* of the separation roller 63 down in FIG. 5 and thus producing another belt alignment, i.e., a secondary belt alignment that brings the secondary transfer belt 61 back to the left in FIG. 5.

The secondary transfer belt 61 is moved to a place at which the initial belt misalignment and the secondary belt misalignment of the secondary transfer belt 61 caused by the inclination of the rotary shaft 63*a* are balanced, thereby correcting the misalignment of the secondary transfer belt 61. Even when the secondary transfer belt 61 traveling at the balanced position wanders toward either side again, the rotary shaft 63*a* of the separation roller 63 is caused to be inclined in accordance with the misalignment of the secondary transfer belt 61, thereby bringing the secondary transfer belt 61 to another balanced position again.

According to the present illustrative embodiment, the shaft moving device 70 of the secondary transfer device 60 tilts the rotary shaft 63*a* of the separation roller 63 at an inclination angle corresponding to the amount of misalignment of the secondary transfer belt 61 in the direction of the belt width. Accordingly, misalignment of the secondary transfer belt 61 is corrected fast. Furthermore, in order to tilt the rotary shaft 63*a* of the separation roller 63, the moving force of the secondary transfer belt 61 moving in the direction of the belt width is used so that the rotary shaft 63*a* of the separation roller 63 can be tilted with a simple configuration without an additional drive source such as a motor.

Figure 7:
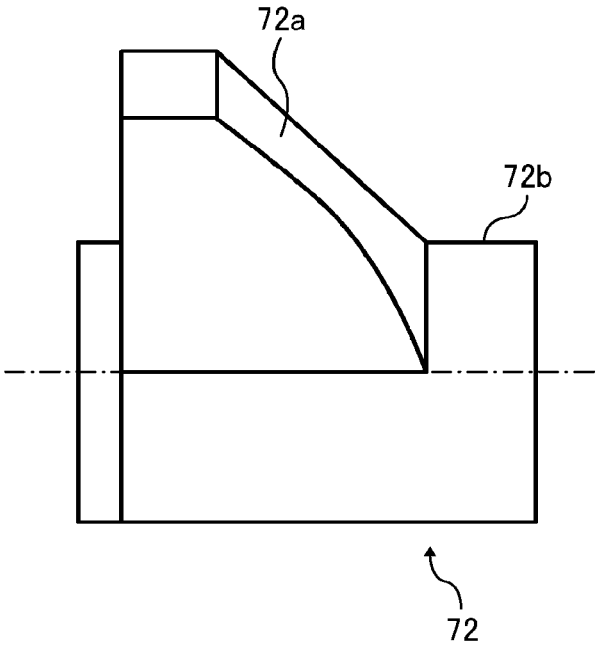
FIG. 7 is a perspective view schematically illustrating a shaft inclining member of the shaft moving device.

Next, with reference to FIG. 7, a description is provided of the configuration of the shaft inclining member 72.

FIG. 7 is a perspective view of the shaft inclining member 72 according to an illustrative embodiment of the present disclosure.

According to the present illustrative embodiment, the shaft inclining member 72 includes a cylindrical main body, and the outer circumferential surface of the cylindrical main body includes the slanted surface 72*a*. The slanted surface 72*a* is formed of a curved surface that constitutes a part of the circumference of a conical shape, the center of which is the center axis of the cylindrical main body.

There are two reasons for forming the slanted surface 72*a* with a curved surface. The first is that even when the shaft inclining member 72 rotates slightly around the rotary shaft 63*a* of the separation roller 63, the angle of inclination of the separation roller 63 does not change. The second is that the curved surface of the slanted surface 72*a* allows the slanted surface 72*a* and the contact portion 68*a* of the frame 68 to make contact in a line, thereby reducing friction at the contact place. With this configuration, the contact pressure at the edge of the secondary transfer belt 61 contacting the belt deviation detector 71 is reduced, thereby reducing damage to the edge of the secondary transfer belt 61 and hence extending belt life expectancy.

According to the present illustrative embodiment, the slanted surface 72*a* is tilted at an inclination angle $\beta$ of approximately 30° relative to the rotary shaft 63*a*. Preferred material of the shaft inclining member 72 includes, but is not limited to, polyacetal (POM).

A bending stress acts repeatedly on the edge of the outer circumferential surface and of the inner circumferential surface of the secondary transfer belt 61 due to contact with the belt deviation detector 71. For better durability of the secondary transfer belt 61, reinforcing tape may be wound around the edge of the inner and outer circumferential surfaces of the secondary transfer belt 61.

According to the present illustrative embodiment, the outward movement of the shaft inclining member 72 in the axial direction is restricted to a certain range. More specifically, an outer end surface 72*c* of the shaft inclining member 72 in the axial direction comes in contact with a stopper surface 68*c*, thereby preventing the shaft inclining member 72 from moving further outward in the axial direction. In the present illustrative embodiment, the stopper surface 68*c* of the frame 68 restricts the outward movement of the shaft inclining member 72 in the axial direction. Alternatively, the support arm 64 and the shaft bearing 65 may restrict the outward movement of the shaft inclining member 72 in the axial direction.

Next, a description is provided of examples of specific configurations of the separation roller 63 and the secondary transfer belt 61.

In one configuration, the diameter of the separation roller 63 is approximately ϕ15. The material thereof is aluminum. The material of the secondary transfer belt 61 includes polyimide. Young's modulus of the secondary transfer belt 61 is approximately 3000 MPa. Folding endurance of the secondary transfer belt 61 measured by the MIT-type folding endurance tester is approximately 6000 times. The thickness of the secondary transfer belt 61 is approximately 80 μm. The linear velocity of the secondary transfer belt 61 is approximately 352 mm/s. The belt tension is approximately 0.9 N/cm. It is to be noted that the folding endurance measurement by the MIT-type folding endurance tester conforms to the Japanese Industrial Standard (JIS) P8115. More specifically, the measuring conditions of the folding endurance testing are as follows: Testing load: 1 kgf, Flexion angle: 135 degrees, Flexion speed: 175 times per minute. A sample belt has a width of 15 mm.

The intermediate transfer belt 51 that travels while contacting the outer circumferential surface of the secondary transfer belt 61 is also formed into an endless belt. Consequently, similar to the secondary transfer belt 61, the intermediate transfer belt 51 possibly travels out of alignment. Thus, the intermediate transfer belt 51 is provided with a belt alignment device to adjust misalignment of the intermediate transfer belt 51.

The shaft moving device 70 serving as the belt alignment device of the secondary transfer device 60 can be employed as the belt alignment device for the intermediate transfer belt 51. In terms of durability of the intermediate transfer belt 51 using the shaft moving device 70 as the belt alignment device, reinforcing tape is wound around the edge of the inner and outer circumferential surfaces of the intermediate transfer belt 51. As the reinforcing tape, preferably, a tape made of polyethylene terephthalate (PET) having a width of approximately 6 mm and a thickness of approximately 0.025 mm is used. However, the reinforcing tape is not limited thereto. In a case in which the secondary transfer belt 61 has the same belt width as the intermediate transfer belt 51 or wider, and both the intermediate transfer belt 51 and the secondary transfer belt 61 travel while the outer circumferential surface of the secondary transfer belt 61 contacts the reinforcing tape adhered to the outer circumferential surface of the intermediate transfer belt 51, the reinforcing tape is adhered in such a manner that the surface of the reinforcing tape with burrs is at the adhesion surface side (the belt surface side). With this configuration, burrs of the reinforcing tape do not interfere with movement of the intermediate transfer belt 51 and the secondary transfer belt 61 in the width direction.

As the belt alignment device for the intermediate transfer belt 51, a guide rib that contacts an end surface of the support roller when the intermediate transfer belt 51 travels out of alignment is formed at both ends of the intermediate transfer belt 51 on the inner circumferential surface side thereof. However, when using the guide rib, a portion of the intermediate transfer belt 51 near the boundary between the guide rib and the inner circumferential surface gets damaged easily due to the bending stress acting on the boundary. For this reason, preferably, reinforcing tape is wound around the inner and outer circumferential surfaces of the intermediate transfer belt 51 near the boundary. As the reinforcing tape, preferably, a tape made of polyethylene terephthalate (PET) having a width of approximately 6 mm and a thickness of approximately 0.025 mm is used. However, the reinforcing tape is not limited thereto. In this case, the reinforcing tape is adhered in such a manner that the surface of the reinforcing tape with burrs is at the adhesion surface side (the belt surface side), as needed.

As the belt alignment device for the intermediate transfer belt 51, a steering-type belt alignment device may be employed. More specifically, in this configuration, an edge of the intermediate transfer belt 51 in the width direction of the intermediate transfer belt 51 is detected by a detector, and an end of a shaft of one of support rollers (i.e., a steering roller) around which the intermediate transfer belt 51 is looped is moved by a motor, thereby tilting the shaft of the steering roller. Accordingly, the intermediate transfer belt 51 is moved in the width direction in which the intermediate transfer belt 51 is back on track. The belt alignment device of this kind does not correct misalignment of the intermediate transfer belt 51 by contacting the edge of the intermediate transfer belt 51. Thus, stress on the edge of the intermediate transfer belt 51 is reduced, hence extending the product life of the belt.

Next, a description is provided of an example of the specific configuration of the intermediate transfer belt 51.

The material of the intermediate transfer belt 51 includes polyimide. Young's modulus of the intermediate transfer belt 51 is approximately 3000 MPa. Folding endurance of the intermediate transfer belt 51 measured by the MIT-type folding endurance tester is approximately 6000 times. The thickness of the intermediate transfer belt 51 is approximately 60 μm. The linear velocity of the intermediate transfer belt 51 is approximately 352 mm/s. The belt tension is approximately 1.3 N/cm.

According to the present illustrative embodiment, the amount of relative positional deviation between the intermediate transfer belt 51 and the secondary transfer belt 61 is at maximum when the intermediate transfer belt 51 and the secondary transfer belt 61 move the greatest distance in the opposite direction from each other in the width direction. Therefore, as compared with a configuration in which only one of the intermediate transfer belt 51 and the secondary transfer belt 61 travels out of alignment, the relative positional deviation is large so that if the reinforcing tape is adhered to one of the outer circumferential surfaces of the intermediate transfer belt 51 and the secondary transfer belt 61 it is important to make sure that the reinforcing tape does not get caught by the other belt without the reinforcing tape due to the difference in height of the belt with the reinforcing tape.

Figure 8:
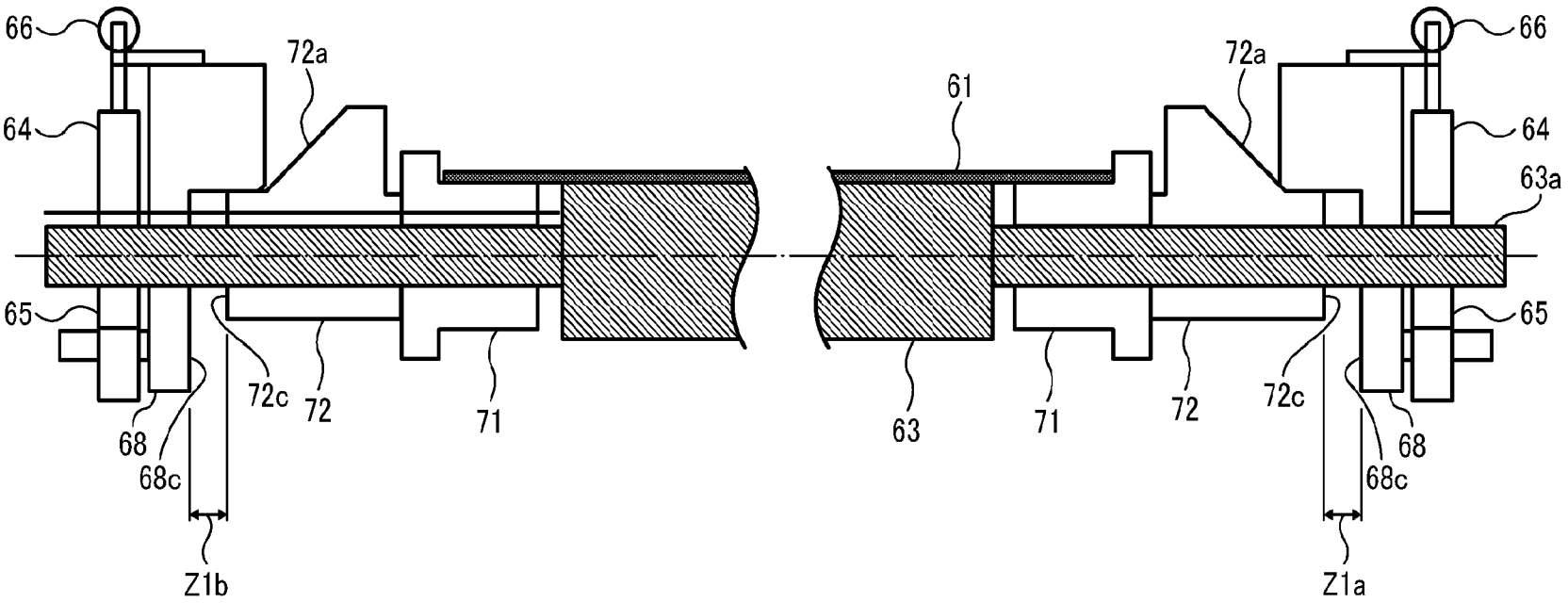
FIG. 8 is a conceptual diagram illustrating the secondary transfer belt at maximum displacement in the width direction of the secondary transfer belt.

As described above, in order to control the displacement amount of the shaft inclining member 72 in the axial direction within a permissible range, the frame 68 includes the contact portion 68*a* and the first stopper surface 68*b*. As illustrated in FIG. 8, the shaft inclining member 72 disposed at both ends of the secondary transfer belt 61 is movable in a space Z1*a* and in a space Z1*b* between the outer end surface 72*c* of the shaft inclining member 72 and the stopper surface 68*c* of the frame 68 in the axial direction. This configuration allows the separation roller 63 to tilt by an amount corresponding to the amount of displacement of the shaft inclining member 72 in the axial direction. The maximum amount of displacement of the secondary transfer belt 61 in the width direction coincides with a sum of the sizes of the space Z1*a* and the space Z1*b* between the outer end surface 72*c* of the shaft inclining member 72 in the axial direction and the stopper surface 68*c* of the frame 68.

When the secondary transfer belt 61 wanders toward one side in the direction of the belt width and travels out of alignment, the edge of the secondary transfer belt 61 contacts the flange 71*a* of the belt deviation detector 71, thereby tilting the rotary shaft 63*a* of the separation roller 63.

Subsequently, the rotary shaft 63*a* of the separation roller 63 is further tilted intentionally to move the secondary transfer belt 61 in the direction of belt width, contacting the edge of the secondary transfer belt 61 against the flange 71*a* of the belt deviation detector 71. As described above referring to FIG. 4, as the secondary transfer belt 61 moves in the direction of the belt width and the edge of the secondary transfer belt 61 contacts the flange 71*a* of the belt deviation detector 71, the secondary transfer belt 61 receives a reaction force in a direction of arrow F' from the flange 71*a*. As a result, the secondary transfer belt 61 creases around the separation roller 63.

When the secondary transfer belt 61 creases around the separation roller 63 by intentionally tilting the rotary shaft 63*a* of the separation roller 63, an adhesiveness between the secondary transfer belt 61 and a recording medium P is decreased. With such a configuration, even a thin recording medium P separates from the secondary transfer belt 61 successfully. In this case, the example of the thin recording medium P includes a thin coated paper, such as Tomoe River paper (a high gloss type), having a thickness of approximately 56 g/m$^2$.

In some embodiments, the secondary transfer belt 61 creases to separate the recording medium P from the secondary transfer belt 61 while the recording sheet P passes through the separation roller 63.

Figure 9:
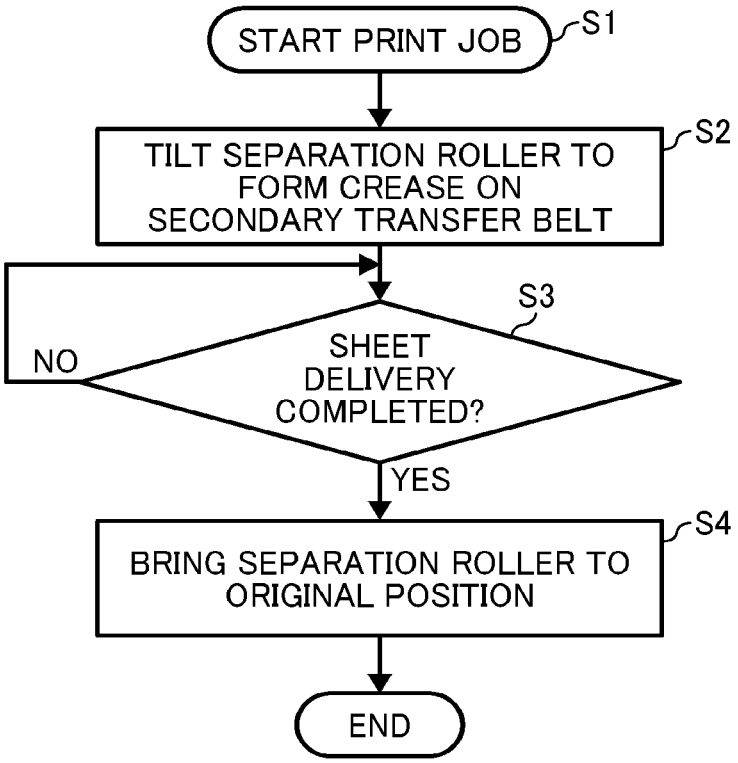
FIG. 9 is a flowchart illustrating a procedure for forming creases on the secondary transfer belt by tilting the rotary shaft of the separation roller.

FIG. 9 is a flowchart of a procedure for forming creases on the secondary transfer belt by tilting the rotary shaft of the separation roller.

In step S1, a print job stars in an image formation apparatus. Delivery of recording medium P starts, accordingly. In the following step S2, the separation roller 63 is tilted at a prescribed inclination angle. Herein, the prescribed inclination angle is an appropriate angle that allows the secondary transfer belt 61 to crease to separate the recording medium P therefrom. In step S3, whether the delivery of the recording medium P is completed is judged. When an affirmative judgment is made in step S3, the process continues to step S4 and the separation roller 63 is brought back to the original position. In contrast, when a negative judgment is made in step S3, repeat step S3.

The size of creases necessary to separate the recording medium P from the secondary transfer belt 61 varies with the material, thickness, and width of the secondary transfer belt 61. In consideration of such characteristics, optimal values of the inclination angle of the separation roller 63 are determined to separate the recording medium P from the secondary transfer belt 61. It should be noted that, in some embodiments, the inclination angle of the separation roller 63 is calculated every time the separation roller 63 tilts. For example, the print job may include a function that detects a position of an end (edge) of the secondary transfer belt 61 and calculates an optimal value of the inclination angle of the separation roller 63 based on the result of the detection between step S1 and step S2 in FIG. 9.

In addition to the configuration in which the secondary transfer belt 61 creases by tilting the rotary shaft 63*a* of the separation roller 63 as described above, a device to be described below that forms creases on the secondary transfer belt 61 is incorporated therewith in some embodiments.

Figure 10A:
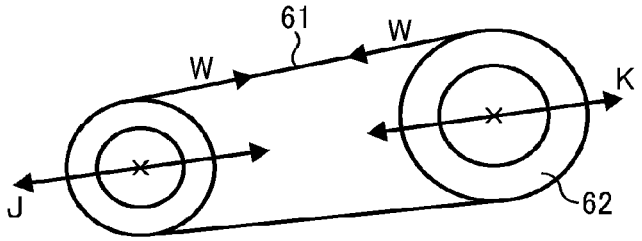
FIG. 10A through FIG. 10C are conceptual diagrams illustrating a device which causes the secondary transfer belt to crease near the separation roller.
Figure 10B:
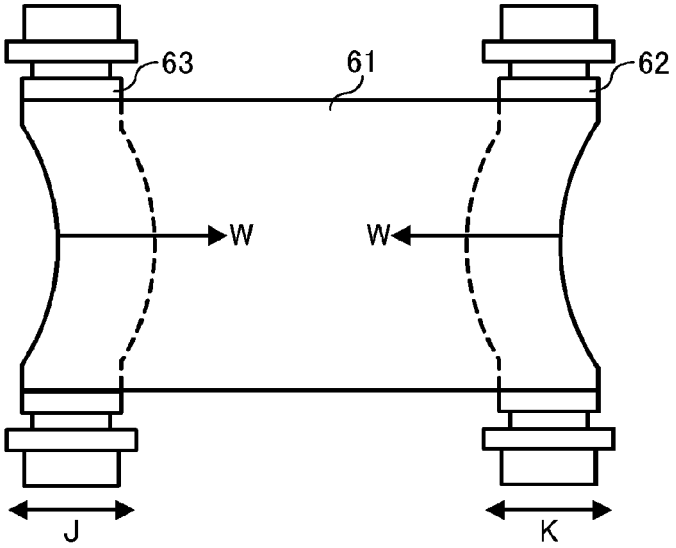
Figure 10C:
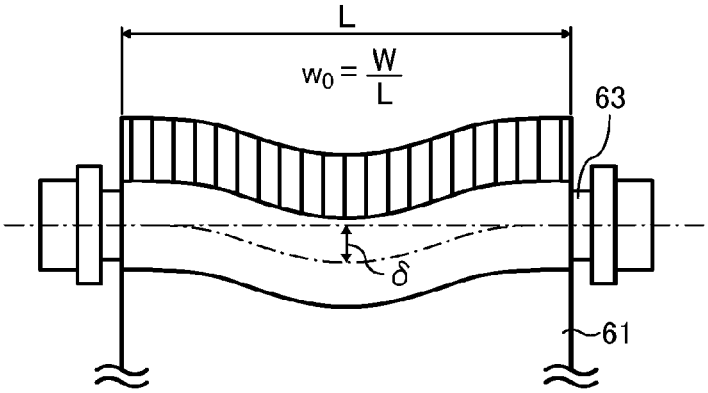

FIGS. 10A through 10C are conceptual diagrams of a device which flexes the separation roller 63 to form creases on the secondary transfer belt 61.

FIG. 10A is a schematic diagram of the secondary transfer device 60, viewed axially along the separation roller 63. In the device to form crease on the secondary transfer belt 61, the tension W of the belt is adjusted by moving the separation roller 63 in a direction of arrow J or moving the secondary transfer roller 62 in a direction of arrow K in FIG. 10A. It should be noted that, in some embodiments, both the secondary transfer roller 62 and the separation roller 63 are moved to adjust the tension of the belt.

FIG. 10B is a diagram of the secondary transfer device 60, as viewed from above. Both the secondary transfer roller 62 and the separation roller 63 flex due to tension W of the secondary transfer belt 61 in some cases. When the secondary transfer roller 62 and the separation roller 63 flex, the tension varies between the end portions and the middle portion of the secondary transfer belt 61 in the width direction, thereby creating creases on the secondary transfer belt 61 around the separation roller 63.

With reference to FIG. 10C, a description is provided of the separation roller 63. As illustrated in FIG. 10C, the tension of the secondary transfer belt 61 is applied to the separation roller 63. Here, it is assumed that a tension W is applied evenly in an axial direction and in a vertical direction of the separation roller 63. As described above, when the separation roller 63 flexes, the tension varies between the end portions and the middle portion of the secondary transfer belt 61 in the width direction. However, the amount of flexion of the separation roller 63 is calculated without considering such a variation in the tension. That is, a distributed load $w_0$, which is applied to the separation roller 63, is expressed with $w_0=W/L$. Here, it is assumed that the symbol "L" denotes the length (which is the same as the width of the secondary transfer belt 61) in the axial direction of a contact portion of the separation roller 63 and the secondary transfer belt 61.

The amount δ2 of flexion of the separation roller 63 is expressed by $\delta 2=(5\times w_0\times L^4)/(384\times E\times I)$. Here, the symbol "E" denotes Young's modulus of the separation roller 63, and the symbol "I" denotes moment of inertia of area. In a case in which the separation roller 63 is hollow, the moment of inertia of area I is expressed by $\pi\times(D^4-d^4)/64$. Here, the symbol "D" is the outer diameter of a metal portion of the separation roller 63, and the symbol "d" is the inner diameter of the metal portion of the separation roller 63. In a case in which the separation roller 63 is solid, the moment of inertia of area I is expressed by $\pi\times D^4/64$.

Next, a description is provided of an example of specific configurations of the secondary transfer roller 62 and the separation roller 63 in this embodiment.

A force applied to the secondary transfer roller 62 and the separation roller 63 from the secondary transfer belt 61 is approximately 40 N. The outer diameter (a metal portion) of the secondary transfer roller 62 is approximately 23.7 mm. The inner diameter of the secondary transfer roller 62 is approximately 19.7 mm. Young's modulus of the metal portion of the secondary transfer roller 62 is approximately 200 GPa. The moment of inertia of area of the secondary transfer roller 62 is approximately $2.72\times10^9$. The amount δ1 of flexion of the secondary transfer roller 62 is approximately 0.014 mm. The outer diameter of the separation roller 63 is approximately 14 mm. The inner diameter of the separation roller 63 is approximately 10 mm. Young's modulus of the metal portion of the separation roller 63 is approximately 200 Gpa. The moment of inertia of area of the separation roller 63 is approximately $1.39\times10^9$. The amount δ2 of flexion of the separation roller 63 is approximately 0.08 mm.

The amount δ1 of flexion of the secondary transfer roller 62 is obtained in the same manner as the amount δ2 of flexion of the separation roller 63. Preferably, the tension W of the secondary transfer belt 61 is adjusted in such a manner that the value of δ1+δ2 is greater than 0.05 (mm). When the value of δ1+δ2 increases too much, the secondary transfer belt 61 is locally applied with a large force. As a result, the secondary transfer belt 61 may get damaged over time. When the secondary transfer belt 61 has a Young's modulus of approximately 3000 MPa, a desired value of δ1+δ2 is less than or equal to 0.5 mm. In FIG. 10C, the symbols "δ1" and "δ2" are collectively indicated by the symbol "δ".

A description is provided of a position of a belt cleaning device that cleans the secondary transfer belt 61.

Figure 11A:
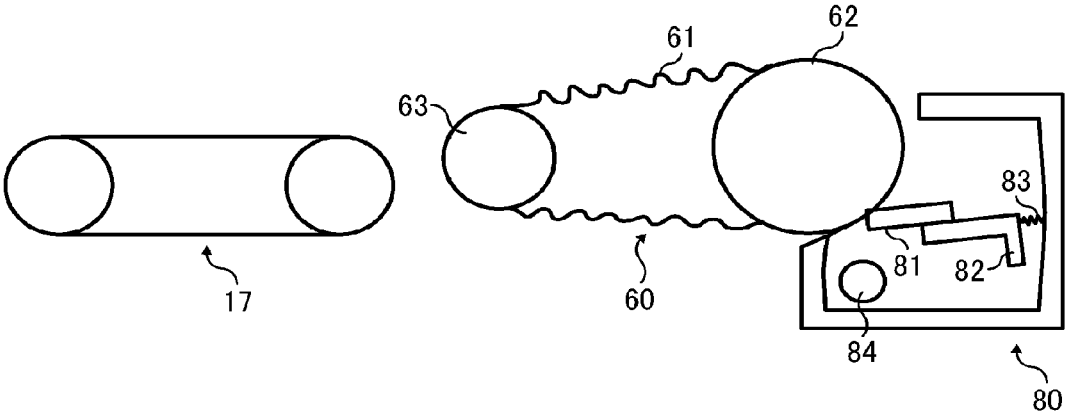
FIG. 11A through FIG. 11C are diagrams illustrating positional relations of the secondary transfer belt and a belt cleaning device which cleans the secondary transfer belt.
Figure 11B:
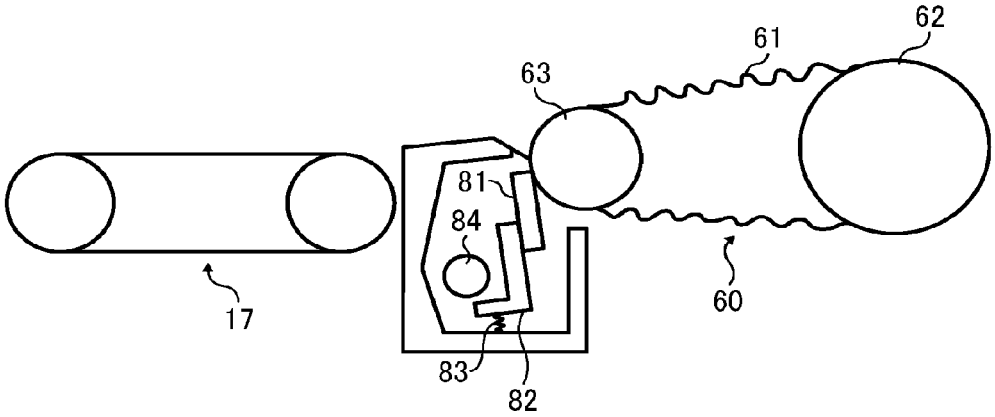
Figure 11C:
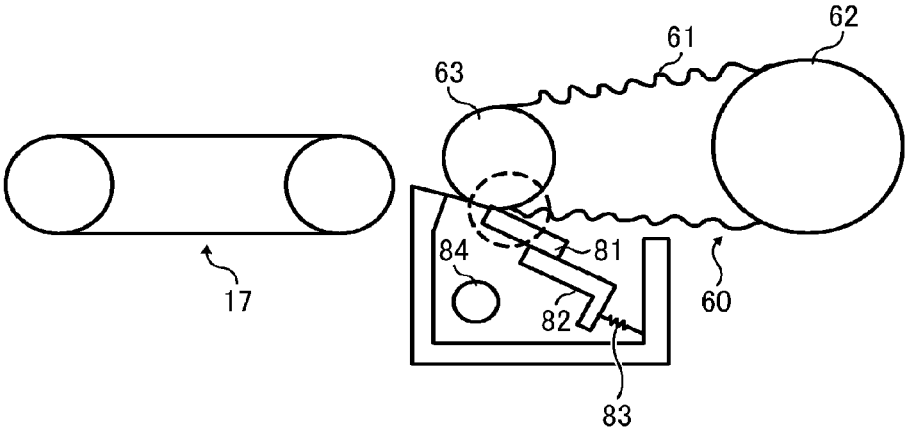

FIG. 11A through FIG. 11C are diagrams of positional relations of the secondary transfer belt 61 and a belt cleaning device 80.

As illustrated in FIG. 11A, the belt cleaning device 80 includes a cleaning blade 81, a blade holder 82, a pressing device 83, and a toner discharge screw 84. The blade holder 82 serving as a support that supports the cleaning blade 81. The pressing device 83 presses the blade holder 82. The toner discharge screw 84 discharges toner in the interior of the belt cleaning device 80.

The cleaning blade 81 is a planar elastic member extending along the width direction of the secondary transfer belt 61, with one edge line (a front end ridge portion) thereof pressed against the surface of the secondary transfer belt 61 to remove residual toner from the surface of the secondary transfer belt 61. The material of the cleaning blade 81 preferably includes, but is not limited to, urethane rubber having good abrasion resistance while preventing the surface of the secondary transfer belt 61, which is in contact with the cleaning blade 81, from being abraded.

Still referring to FIG. 11A, it is preferable that the cleaning blade 81 contacts the secondary transfer belt 61 within a range in which the secondary transfer belt 61 contacts the secondary transfer roller 62. In such a case in which the cleaning blade 81 is held against the secondary transfer belt 61 contacting the secondary transfer roller 62, the amount of flexion of the secondary transfer roller 62 is smaller than that of the separation roller 63. The secondary transfer roller is made of a member that does not easily flex (i.e., a member having a large moment of inertia of area). This is because, when the secondary transfer roller 62 flexes largely, a pressing force is not uniformly applied to the secondary transfer belt 61 from the cleaning blade 81, thereby causing cleaning failure.

A method for flexing the separation roller 63 is not limited to the above-described method in which the separation roller 63 flexes by adjusting a force received from the secondary transfer belt 61 (which is equal to the tension of the secondary transfer belt). For example, in some embodiments, a force is applied to the separation roller 63 from both ends in the axial direction thereof, thus flexing the separation roller 63. With this configuration, the secondary transfer roller 62 does not flex, thereby preventing cleaning failure.

Now referring to FIG. 11B and FIG. 11C, if the cleaning blade 81 is held against the secondary transfer belt 61 within a range in which the secondary transfer belt 61 contacts the separation roller 63 as illustrated in FIG. 11B and FIG. 11C, undesirable outcomes occur. In the case of FIG. 11B, a space for the belt cleaning device is necessary between the secondary transfer device 60 and the conveyor belt 17. If the secondary transfer device 60 is spaced apart from the conveyor belt 17, the recording medium P is not easily fed from the secondary transfer device 60 to the conveyor belt 17.

Further, in the case of FIG. 11C, the cleaning blade contacts the secondary transfer belt 61 at the downstream-most position in the direction of conveyance of the recording medium P within the range in which the secondary transfer belt 61 contacts the separation roller 63. In such a case, the shortcomings in the case of FIG. 11B do not arise. However, there is still a problem with the case of FIG. 11C in that as the secondary transfer belt 61 creases around the separation roller 63, thereby changing the pressing force of the cleaning blade 81 that contacts the creases. As a result, a cleaning failure occurs.

Although an embodiment of the present disclosure has been described above, the present disclosure is not limited to the foregoing embodiments, but a variety of modifications can naturally be made within the scope of the present disclosure.

[Aspect A]

An image forming apparatus includes a belt serving as a secondary transfer belt 61 to carry and convey a recording medium such as a transfer sheet P, a plurality of support rollers including a secondary transfer roller 62 and a separation roller 63 to rotate the belt, and a cleaner such as a cleaning blade 81 to contact and clean the belt. One of the support rollers is a separation support roller such as the separation roller 63 to separate the recording medium from the separation support roller using the curvature of the support roller. The separation support roller includes a contact member such as a belt deviation detector 71 to contact an edge of the belt when the belt moves laterally toward one side of the belt. Such a separation support roller causes the rotary shaft to tilt.

When the separation support roller tilts by tilting the rotary shaft thereof, the belt moves in the direction of belt width and an edge of the belt contacts the contact member. When the belt contacts the contact member and receives a reaction force from the contact member, the belt creases. With such a configuration, even a thin recording medium weak in stiffness can separate from a transfer belt reliably. Further, as the belt contacts the cleaner to remove dust and dirt from the belt, thereby preventing contamination of the recording medium.

[Aspect B]

In Aspect A, the cleaner is held contact against a portion of the belt entrained about at least one support roller other than the separation support roller among the plurality of the support rollers.

A portion of the belt wound around the separation support roller creases. However, if the cleaner contacts a crease portion on the belt, the pressing force of the cleaner varies, thereby resulting in a cleaning failure. Hence, as the cleaner contacts a portion other than the crease portion on the belt, a cleaning failure is prevented.

[Aspect C]

An image forming apparatus includes a latent image bearer, a latent image forming device to form a latent image on the latent image bearer, a developing device to transfer toner onto the latent image formed on the latent image bearer in a development process, and a recording medium conveying device to convey the recording medium. The image forming apparatus transfers a toner image, which has been formed on the latent image bearer in the development process, onto the recording medium and forms an image on the recording medium ultimately. The recording medium conveying device employed in the image forming apparatus includes either the recording medium device of Aspect A or the recording medium of Aspect B.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A recording medium conveying device comprising:

an endless belt to convey a recording medium;

a plurality of support rollers around which the belt is wound, to rotate the belt; and a cleaner in contact with the belt to clean the belt, wherein one of the plurality of support rollers is a separation support roller, mounted on a tiltable rotary shaft, to separate the recording medium from the belt using a curvature of the separation support roller, wherein one of the plurality of support rollers is a secondary transfer roller, and the belt is entrained about the secondary transfer roller and the separation support roller, the separation support roller includes a contact member to contact an edge of the belt when the belt laterally moves toward one side of the belt, and wherein the cleaner contacts a portion of the belt in a range in which the belt contacts the secondary transfer roller.

2. An image forming apparatus comprising:

a latent image bearer;

a latent image forming device to form a latent mage on the latent image bearer;

a developing device to transfer toner onto the latent image formed on the latent image bearer to form a toner image on the latent image bearer;

the recording medium conveying device of claim 1 to convey a recording medium; and a transfer device to transfer the toner image, which has been formed on the latent image bearer, onto the recording medium to form an image on the recording medium.

3. The recording medium conveying device of claim 1, further comprising a shaft moving device to tilt the tiltable rotary shaft to adjust misalignment of the endless belt within a predetermined range.

4. The recording medium conveying device of claim 1, wherein each end of the separation support roller is supported individually by different shaft support arms.

5. The recording medium conveying device of claim 4, wherein each shaft support arm slidably supports a shaft bearing that bears the tiltable rotary shaft such that the shaft bearing is slidable in a radial direction from a center of rotation of the shaft support arm.

6. The recording medium conveying device of claim 5, wherein the shaft bearing is biased outside by a tension spring in a radial direction from the center of rotation of the shaft support arms.

7. The recording medium conveying device of claim 1, wherein the contact member moves outward in an axial direction along the tiltable rotary shaft when the edge of the belt contacts the contact member.

* * * * *